United States Patent [19]

McClanahan

[11] Patent Number: 4,824,411

[45] Date of Patent: Apr. 25, 1989

[54] SEGMENTED FORMABLE FLOAT APPARATUS AND METHOD

[76] Inventor: Gary McClanahan, 712 Grove St., Graham, Tex. 76046

[21] Appl. No.: 148,041

[22] Filed: Jan. 25, 1988

[51] Int. Cl.[4] ..... B63B 35/86

[52] U.S. Cl. ..... 441/129; 5/465

[58] Field of Search ..... 5/465; 441/44, 45, 80, 441/108, 125, 126, 127, 128, 129; 297/1

[56] References Cited

U.S. PATENT DOCUMENTS

| | | | |
|---|---|---|---|
| 264,814 | 9/1882 | Wood | 441/129 X |
| 1,829,137 | 10/1931 | Harris | 441/129 |
| 4,275,473 | 6/1981 | Poirier | 5/465 X |
| 4,451,240 | 5/1984 | Wood | 441/129 |
| 4,634,393 | 1/1987 | Wood | 441/129 |

FOREIGN PATENT DOCUMENTS

| | | | |
|---|---|---|---|
| 1127362 | 12/1956 | France | 441/80 |
| 7384 | of 1914 | United Kingdom | 441/108 |

*Primary Examiner*—Sherman D. Basinger

*Attorney, Agent, or Firm*—J. Nevin Shaffer, Jr.

[57] ABSTRACT

A segmented formable float having a series of parallel separate shaped flotation sections encapsulated and covered by a connecting covering. The connecting covering contains uniform spaces between each flotation section so that the flotation sections, when folded onto itself, are held in place, where folded.

8 Claims, 1 Drawing Sheet

SEGMENTED FORMABLE FLOAT APPARATUS AND METHOD

BACKGROUND OF THE INVENTION

This invention relates to a segmented formable float capable of being folded into various positions and maintaining the position one folded.

A variety of flotation devices have been known in the art for quite some time. For example, life preservers have been developed for use that also double as cushions. An example of such a life preserving cushion is disclosed in Wood, U.S. Pat. No. 264,814, which utilizes a buoyant material such as granulated cork in combination with air, to provide the device with buoyancy. Additionally, the inventor discloses the idea of using a series of straps and buckles to connect individual segments to each other.

An early example of a "bathing float" is disclosed in Harris, U.S. Pat. No. 1,829,137, which discloses a series of individual sections of cork covered with canvas and joined together substantially directly to each other by means of canvas stitching. Rigidity for the device is provided and enhanced by means of rods on either side of the device.

More recently, the Wood Patents, U.S. Pat. Nos. 4,451,240 and 4,634,393, disclose "aquatic mats." The mats are comprised of an elongated slab with a head rest formed of the same material. The devices describe "grooves" which are designed to enable easy rolling of the mat.

A drawback to the floats known in the art is that they are difficult to fold into any other form than the flat form which they normally take. It is particularly difficult, if not impossible, to fold an air mattress once it is inflated with air. The typical air mattress will maintain the position that the inflated form allows, but must be emptied of air in order to be rolled and transported.

For flotation devices, aquatic mats, and the like not depending upon air for buoyancy, folding is almost as difficult as the air mattress. Further, once folded, some additional means must be utilized in order to maintain the mat in the folded position. Further still, the aquatic mats, flotation devices, and the like, known in the art, are not capable of being folded and being floated upon at the same time.

Thus, there is a need in the art for providing a segmented formable float which is capable of being folded into a compact position. Additionally, there is a further need in the art for providing such a formable float that may be folded into a variety of pleasing configurations while at the same time being used. It, therefore, is an object of this invention to provide a unique, improved segmented formable float capable of being easily folded into a variety of positions and either transported or used in the positions into which it has been folded.

SHORT STATEMENT OF THE INVENTION

Accordingly, the segmented formable float of the present invention includes approximately 10 to 12 separate, shaped, sections of flotation material. These separate sections are placed parallel to each other and encapsulated and connected by a covering which surrounds each of the flotation sections. The connection of the flotation pieces is accomplished by means of the covering, which also distinctly separates each section from each other by some distance. As a result, once encapsulated by the covering, the individual segmented sections will, upon folding, fit partially into the space between sections and be held in position by the contact of the folded section with the section into which it has been folded. A further embodiment of the invention includes the use of stretchable covering material for the joining section. The material would stretch slightly in the direction perpendicular to the parallel sections allowing the section to be spread apart by the introduction of the folded section and then drawn back together by the elastic material so that the holding power of the device is enhanced.

BRIEF DESCRIPTION OF THE DRAWINGS

Other objects, features and advantages of the present invention will become more fully apparent from the following detailed description of the preferred embodiment, the appended claims and the accompanying drawings in which:

FIG. 4 is a plan view of the device formed to create a chair to float on.

DETAILED DESCRIPTION OF THE PREFERRED EMBODIMENT

Figure 1:
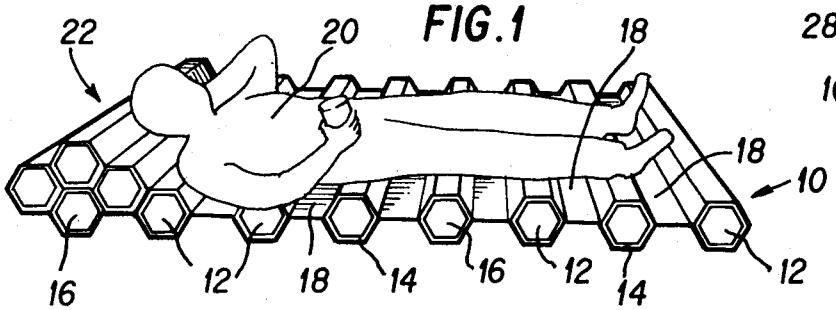
FIG. 1 is a plan view of a preferred embodiment of the segmented formable float of the present invention showing the device being utilized by a bather with the section toward the bather's feet unfolded and the section toward the bather's head folded and illustrating the interlocking capabilities of the device.

The preferred embodiment of the present invention is illustrated by way of example in FIGS. 1–4. With specific reference to FIG. 1, a segmented formable float 10 includes separate, shaped, flotation sections 12 arranged in parallel order. Connecting covering 14 encapsulates and surrounds each separate, shaped, flotation section 12, except for the ends 16. Further, the unique design of the invention includes the construction of a series of spaces 18 between each separate, shaped, flotation section 12. FIG. 1 shows a bather 20 utilizing float 10 in water, not shown, as a float with a head rest 22 formed by means of folding one end of float 10 so that the separate, shaped, flotation sections 12 of the folded end fold upon each other and into spaces 18.

Figure 2:
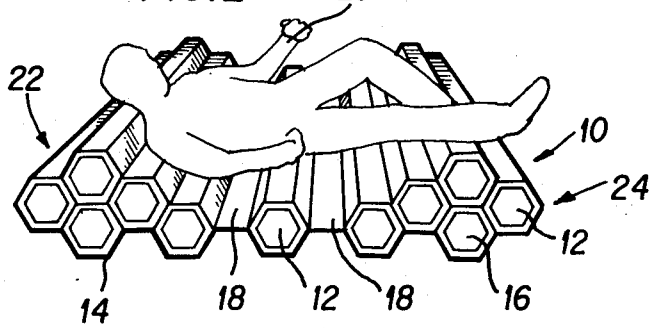
FIG. 2 is a plan view of the segmented float shown being utilized by a bather with the float folded at both ends.

Referring now to FIG. 2, segmented formable float 10 is shown being utilized by bather 20 while floating in a pool, ocean or some other water, not shown, after having formed the float 10 into the desired configuration, which in this case includes head rest 22 and foot rest 24.

Figure 3:
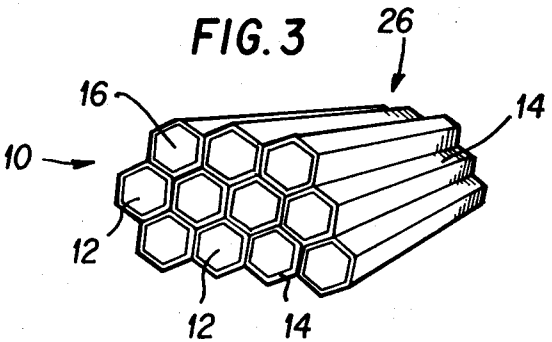
FIG. 3 is a plan view of the device in the completely rolled position.

Referring now to FIG. 3, segmented formable float 10 is shown in the folded position 26.

Figure 4:
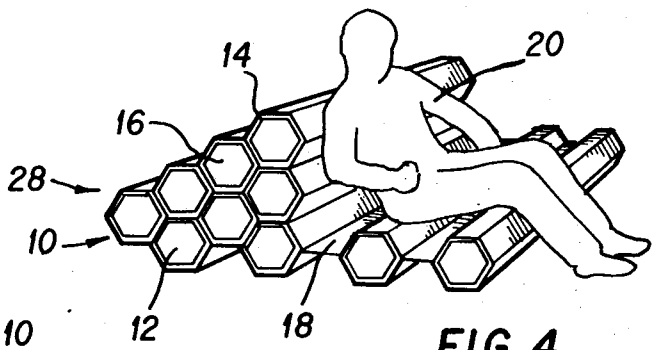

FIG. 4 shows bather 20 utilizing the device in water, not shown, in seat position 28.

The segmented formable float 10 of the preferred embodiment is comprised of approximately 10 to 12, separate shaped flotation sections 12. Flotation sections 12 may be made of any buoyant material known in the art, such as plastic, foam, or the like. Flotation sections 12 may even be made of individual air flotation tubes which may be inflated with air for use. Although the preferred embodiment of the float requires no inflation, the inflatable tubes, once inflated, can be left in their inflated position and, because of the unique design of the float 10, can still be rolled up and be made easily portable as shown in FIG. 3.

A sufficient amount of connecting covering 14 is used in the manufacturing process to cover the parallel array of sections 12 top and bottom, as illustrated, except for ends 16, which can be, and are, left open to the water. The fabric of connecting covering 14 is bonded by any means known in the art, such as heat sealing, stitching, or other processes in such a manner as to contain sections 12 and provide for the spaces 18.

In use, float 10 provides a unique flotation device in that each separate, shaped, flotation section 12 conforms to th contours of the individual body, while at the same time the connecting covering 14 enables each section 12 to float somewhat independently of each other.

A primary advantage of the segmented formable float 10 over floats known in the art is that it is more versatile than any other known float since it can be shaped into a variety of positions including, but not limited to, head rest 22, foot rest 24, folded position 26, and seat position 28, as desired. Most importantly, because of the design of the float 10, when the separate, shaped, flotation sections 12 are folded upon one another, because of the spaces 18, in connecting covering 14, the sides of sections 12 are enabled to come into close proximity to each other, and, because of this closeness and because they are buoyant but separate, they maintain the position selected by bather 20.

This unique ability to provide a flotation device, without the necessity of inflating and deflating the device on a regular basis, among other things, is further exemplified by the fact that the device, once rolled as shown in FIG. 3, for instance, does not have the propensity to unroll itself as is the problem with other floats and aquatic mats known in the art. As a result, not only is segmented formable float 10 easy to roll into the folded position 26, but once rolled into folded position 26, float 10 will maintain that position without the necessity of straps or other means to keep it in that position and is therefore, easily transportable in the folded position 26.

In operation, bather 20 transports segmented formable float 10 in the folded position 26 to the body of water upon which bather 20 chooses to float. Once segmented formable float 10 is placed in the water, bather 20 may float on it in its totally unrolled position, not shown, or may select a variety of other configurations for fun and comfort. FIG. 1 shows bather 20 utilizing segmented formable float 10 in the resting position having formed head rest 22. FIG. 2 shows bather 20 lounging on float 10 wherein float 10 has been formed into having a head rest 22 and a foot rest 24. It should be obvious from FIG. 2 that bather 20 could swing his legs to sides of the center of the float 10 and place his arms on either side of head rest 22 and foot rest 24 for another unique floating position.

FIG. 4 illustrates formable float 10 in the seat position 28. In this position, bather 20 can hang his feet over one end of float 10 while resting his back on the remainder of float 10 as it has been formed into a backrest. In fact, the device can be used in this position as a chair beside the pool or on the beach when not in the water.

The segmented formable float 10 has been illustrated in 12 FIGS. 1–4 with separate, shaped, flotation sections 12 in hexagonal form. The use of this shape has been found to enhance the ability of the device to retain its form when folded. This is because of the fact that the sides of the individual sections are brought into close contact with each other as enabled by means of spaces 18.

The ability of segmented formable float 10 to retain separate, shaped, flotation sections 12 in the desired folded positions has been determined to be satisfactory as described. Nonetheless, another embodiment of the invention includes the utilization of a slightly stretchable, elastic, material for use as the connecting covering 14 in whole or in part. If in part, only spaces 18 would be formed of stretchable material. The advantage being that if spaces 18 are formed of slightly stretchable material, then when separate, shaped, flotation sections 12 are folded and the sections are forced into spaces 18, the stretchable material allows connecting covering 14 to expand slightly and then to contract upon the inserted section 12 thereby enhancing the ability of the invention to retain its folded position.

Further, while the preferred embodiment of the present invention has been disclosed with hexagonal shaped sections 12, it has been determined that other shapes and forms, such as oval, square, round, and the like, are also suitable and also perform as described above in that the separate sections 12 fit into spaces 18 and retain the selected folded position.

While the present invention has been disclosed in connection with the preferred embodiment thereof, it should be understood that there may be other embodiments which fall within the spirit and scope of the invention as defined by the following claims.

What is claimed is:

1. A segmented formable float comprising:

A. a plurality of parallel, separate, shaped flotation means;

B. an encapsulating connecting covering means surrounding said flotation means so that said flotation means are separated from each other by spaces of said covering means and so that said flotation means, when folded onto itself, is held in place where folded, by the combination of said shaped flotation means with said spaces of said covering means; and C. wherein the sides of said flotation means just fit into said spaces and contact other sides of said flotation means and is further held in position thereby.

2. The apparatus of claim 1 wherein said encapsulating connecting covering means is stretchable in a direction perpendicular to said parallel shaped flotation means so that when said shaped flotation means is folded into said spaces, said spaces expand slightly to accept said shape then contract slightly thereby enhancing the holding of said shapes in place.

3. A segmented formable float comprising:

A. a plurality of parallel, separate, shaped flotation means;

B. an encapsulating connecting covering means surrounding said flotation means so that said flotation means are separated from each other by spaces of said covering means and so that said flotation means, when folded onto itself, is held in place where folded, by the combination of said shaped flotation means with said spaces of said covering means; and C. wherein said shaped flotation means are hexagonal in shape so that when folded, the sides of said hexagonal shape just fit into said spaces and contact other sides of said flotation means and is held in position thereby.

4. The apparatus of claim 3 wherein said encapsulating connecting covering means is stretchable in a direction perpendicular to said parallel shaped flotation means so that when said shaped flotation means is folded into said spaces, said spaces expand slightly to accept said shape then contract slightly thereby enhancing the holding of said shapes in place.

5. A segmented formable float method comprising the steps of:

A. constructing a plurality of parallel, separate, shaped flotation means;

B. surrounding said shaped flotation means with an encapsulating connecting covering means so that said flotation means are separated from each other by spaces of said covering means and so that said flotation means, when folded onto itself, is held in place where folded, by the combination of said shaped flotation means with said spaces of said covering means; and C. forming said shaped flotation means into a shape so that when folded, the sides of said shape just fit into said spaces and contact other sides of said flotation means and is further held in position thereby.

6. The method of claim 5 further comprising the step of constructing said encapsulating connecting covering means of material stretchable in a direction perpendicular to said parallel shaped flotation means so that when said shaped flotation means is folded into said spaces, said spaces expand slightly to accept said shape then contract slightly thereby enhancing the holding of said shapes in place.

7. A segmented formable float method comprising the steps of:

A. constructing a plurality of parallel, separate, shaped flotation means;

B. surrounding said shaped flotation means with an encapsulating connecting covering means so that said flotation means are separated from each other by spaces of said covering means and so that said flotation means, when folded into itself, is held in place where folded, by the combination of said shaped flotation means with said spaces of said covering means; and C. forming said shaped flotation means into a hexagonal shape so that when folded, the sides of said hexagonal shape just fit into said spaces and contact other sides of said flotation means and is held in position thereby.

8. The method of claim 7 further comprising the step of constructing said encapsulating connecting covering means of material stretchable in a direction perpendicular to said parallel shaped flotation means so that when said shaped flotation means is folded into said spaces, said spaces expand slightly to accept said shape then contract slightly thereby enhancing the holding of said shapes in place.

* * * * *